US008973793B2

(12) United States Patent
Arvan

(10) Patent No.: US 8,973,793 B2
(45) Date of Patent: Mar. 10, 2015

(54) INFANT SUPPORT GARMENT

(71) Applicant: Julie Arvan, San Francisco, CA (US)

(72) Inventor: Julie Arvan, San Francisco, CA (US)

( * ) Notice: Subject to any disclaimer, the term of this patent is extended or adjusted under 35 U.S.C. 154(b) by 201 days.

(21) Appl. No.: 13/760,041

(22) Filed: Feb. 5, 2013

(65) Prior Publication Data

US 2013/0200116 A1 Aug. 8, 2013

Related U.S. Application Data

(60) Provisional application No. 61/633,206, filed on Feb. 6, 2012.

(51) Int. Cl.
*A47D 13/02* (2006.01)

(52) U.S. Cl.
USPC ..... 224/159; 224/158; 224/160

(58) Field of Classification Search
USPC ..... 224/158–160
See application file for complete search history.

(56) References Cited

U.S. PATENT DOCUMENTS

| | | | | | |
|---|---|---|---|---|---|
| 3,780,919 | A * | 12/1973 | Hansson | 224/160 |
| 3,871,562 | A * | 3/1975 | Grenier | 224/160 |
| 4,234,229 | A * | 11/1980 | Arnold | 297/467 |
| 4,428,514 | A * | 1/1984 | Elf | 224/579 |
| 4,986,458 | A * | 1/1991 | Linday | 224/160 |
| 5,020,709 | A * | 6/1991 | Hoaglan | 224/155 |
| 5,246,152 | A * | 9/1993 | Dotseth | 224/159 |
| 5,678,739 | A * | 10/1997 | Darling et al. | 224/160 |
| 5,692,655 | A * | 12/1997 | Fair et al. | 224/160 |
| 5,813,580 | A * | 9/1998 | Fair | 224/160 |
| 5,934,528 | A * | 8/1999 | Higuchi | 224/159 |
| 6,409,060 | B2 * | 6/2002 | Donine | 224/160 |
| 6,988,644 | B1 * | 1/2006 | Asherbranner | 224/160 |
| 7,252,214 | B2 * | 8/2007 | Krogh | 224/160 |
| 7,484,645 | B2 * | 2/2009 | Hoff et al. | 224/160 |
| 7,886,946 | B2 * | 2/2011 | Gray | 224/160 |
| 8,028,871 | B2 * | 10/2011 | Gray | 224/160 |
| 8,272,546 | B2 * | 9/2012 | Leistensnider | 224/158 |
| 8,636,181 | B2 * | 1/2014 | Gunter et al. | 224/160 |
| 8,752,739 | B2 * | 6/2014 | Bergkvist et al. | 224/160 |
| 2002/0175194 | A1 * | 11/2002 | Norman | 224/160 |
| 2005/0077330 | A1 * | 4/2005 | Fernandez | 224/160 |
| 2005/0133551 | A1 * | 6/2005 | Heidt | 224/160 |
| 2005/0184114 | A1 * | 8/2005 | Hoff et al. | 224/160 |
| 2007/0278264 | A1 * | 12/2007 | Chesal et al. | 224/160 |
| 2009/0206116 | A1 * | 8/2009 | Grant | 224/160 |
| 2012/0286002 | A1 * | 11/2012 | Dardel et al. | 224/159 |

* cited by examiner

*Primary Examiner* — Brian D Nash

(57) ABSTRACT

The present invention relates generally to infant support garments configured for supporting and maintaining an infant against a wearer of the garment. In one exemplary embodiment, the garment provides a first pocket suitable for placement and securing of an infant. The garment further provides a second pocket that is adjustable to provide further securing and support of the infant. In one particular exemplary embodiment, the garment further provides a third pocket for added securing and support.

19 Claims, 11 Drawing Sheets

INFANT SUPPORT GARMENT

CROSS-REFERENCE TO RELATED APPLICATION

The present application claims benefit of U.S. provisional patent application No. 61/633,206, filed Feb. 6, 2012, the contents of which are hereby incorporated by reference in their entirety for all purposes.

FIELD OF THE INVENTION

The present invention relates generally to infant support garments configured for supporting and maintaining an infant against a wearer of the garment.

BACKGROUND OF THE INVENTION

Following birth of a child it is important to develop a paternal bond with the infant to promote a state of comfort and wellbeing. The security provided to the infant at this early stage can have positive lasting effects throughout their life. To this end, parents often spend substantial amounts of time holding their infant, both during the day and late into the night, to generate bonding and promote a calming effect. However, while bonding is comforting for both parents and infant, it is difficult for parents, particular the mother, to return to everyday life and continue with tasks previously performed before birth. For example, common tasks such as preparing meals, grocery shopping, cleaning, working from home, assisting other children, or otherwise, become increasingly difficult. The increase in commitments leaves the parents either sacrificing bonding time with their infant or exchanging the infant between one another. This problem is particularly exaggerated with single parents or families having a parent spending substantial amounts of time away from home.

Parents and manufacturers of childcare products have attempted to provide means for maintaining continual bonding with an infant but also allow for the resuming of everyday tasks. In one attempt, individuals have utilized long blankets, towels, or the like, to wrap around their body, over their clothing, to form a pocket for receiving and maintaining an infant against their body. Such devices provide a blanket having a length of approximately 15 to 20 feet with detailed instructions on wrapping procedures for forming a pocket for receiving a baby. Unfortunately, the complexity of the wrapping has resulted in complex instructions and the creation of many online videos for teaching individuals how to use the product. As shown in the videos, the infant must be placed down during the initial wrapping. After the initial wrapping, the user places the infant in a partial pocket and awkwardly attempts to continue to wrap the infant while carefully maintaining pressure against the infant to prevent dropping. After several minutes, the infant is finally secured against the wearer, albeit against the wearer's clothing. However, it has been discovered that while utilizing the device, the wrapping has a propensity to continuously loosen requiring the wearer to adjust and tighten ends of the wrappings. Accordingly, the device is both complex to use and requires continual maintenance.

Many other manufacturers of child care products have also provided devices for supporting infants. Most, if not all, of such devices provide externally worn carriers that include various straps, buckles, clasps, frames, or otherwise, that can be uncomfortable to wear over time. In certain configurations, such as slings, the devices are not ergonomically correct and place excessive strain on the back, shoulder and other body parts of the wearer. Also, many of these devices are designed to be utilized with dressed infants since they are worn externally to wearer of the device.

In view of the foregoing, there is a need to provide improved infant carrying devices that are easy to use, comfortable to wear and safe for the infant during placement or removal of the device.

SUMMARY OF THE INVENTION

The present invention provides an infant support device and more particularly an infant support garment wearable as a standalone garment or over another garment. The infant support garment is particularly suited for infants from approximately 0 to 3 months and weights of approximately 5 to 15 pounds, but may also be used with smaller or larger infants and babies. In certain configuration, such as with smaller twins, the infant support garment can be used with multiple infants. Also, the infant support garment is adjustable and maintains the infant in an advantageous position against the wearer to minimize stress on the wearer's back and holds the infant in a comfortable, safe ergonomically healthy position and provides support to an infant's head, neck and back. Further, through the use of one or more expandable performance fabrics, the position of the infant can be controlled and maintained while performing various activities.

The infant support garment is also configured as a body shaper which not only aids in providing confidence in ones appearance, but also assists in abdominal recover after birth and encourages breast feeding. The infant support garment is wearable by a male or female, is easy to place onto a wearer and provides a pouch for secure placement of an infant during installment. Advantageously, the infant support garment is free from unnecessary frames, buckles, straps or other hardware and is free of hard edges, which make the garment comfortable for both the infant in the wearer. Further, the infant support garment is easy to use and requires little to no instructions for use.

In view of the forgoing, in one exemplary embodiment, the infant support garment forms a plurality of pouches for receiving an infant. The garment provides a first pocket suitable for placement and securing of an infant, a second pocket that is adjustable to provide further security and support of the infant and a third pocket for added security and support. For example, in a first aspect, the present invention provides an infant support garment. The garment includes a tubular member having a front portion and a rear portion. The garment further includes a first shoulder member extending to the front portion of the tubular member, the first shoulder member forming a first pocket with the tubular member. The garment further includes a second shoulder member extending to the front portion of the tubular member, the second shoulder member forming a second pocket with the tubular member, wherein the first pocket and the second pocket are overlapping.

In another aspect, the present invention provides an infant support garment. The garment includes a flexible elastic tubular member having a front portion and a rear portion. The tubular member is suitable in length to extend generally from a breast portion to a pelvic portion of an average sized adult person. The garment further includes a first shoulder member extending from the front portion of the tubular member to the rear portion of the tubular member. The first shoulder member is attached to the front portion of the tubular member and rear portion of the tubular member. The first shoulder member forms a first pocket with the tubular member. The garment further includes a second shoulder member extending from the front portion of the tubular member to the rear portion of the tubular member. The second shoulder member forms a second pocket with the tubular member. The garment further includes an adjustment feature to vary the dimensions of the second pocket.

These and other features of the present invention can be best understood from the following specification and drawings, the following of which is a brief description.

BRIEF DESCRIPTION OF THE DRAWINGS

Other objects, features, advantages and details of the present invention appear, by way of example only, in the following detailed description of preferred embodiments of the invention, the detailed description referring to the drawings in which.

DETAILED DESCRIPTION OF THE INVENTION

Figure 1:
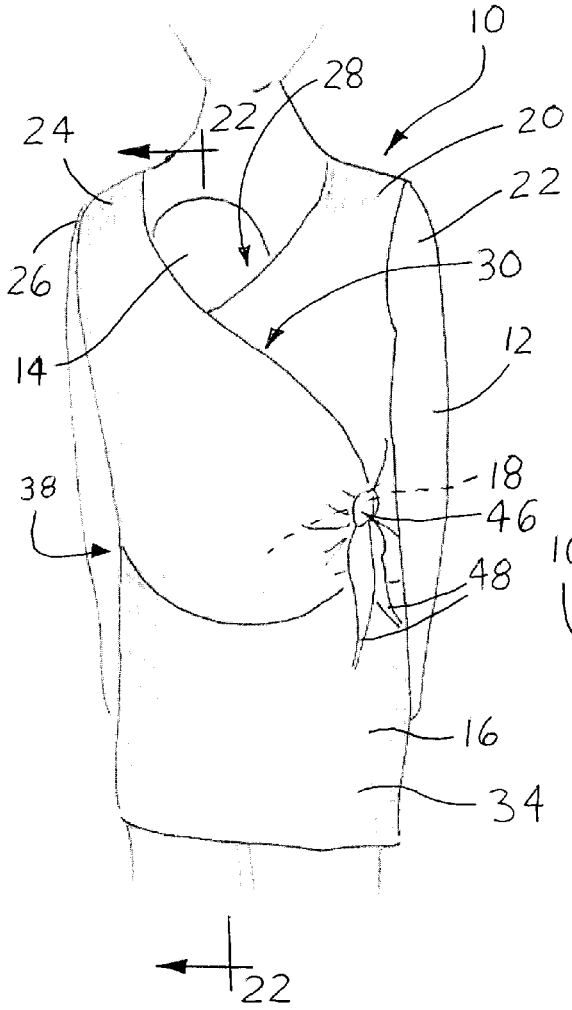
FIG. 1 illustrates a perspective view of an exemplary infant support garment according to the teachings of the present invention.
Figure 2:
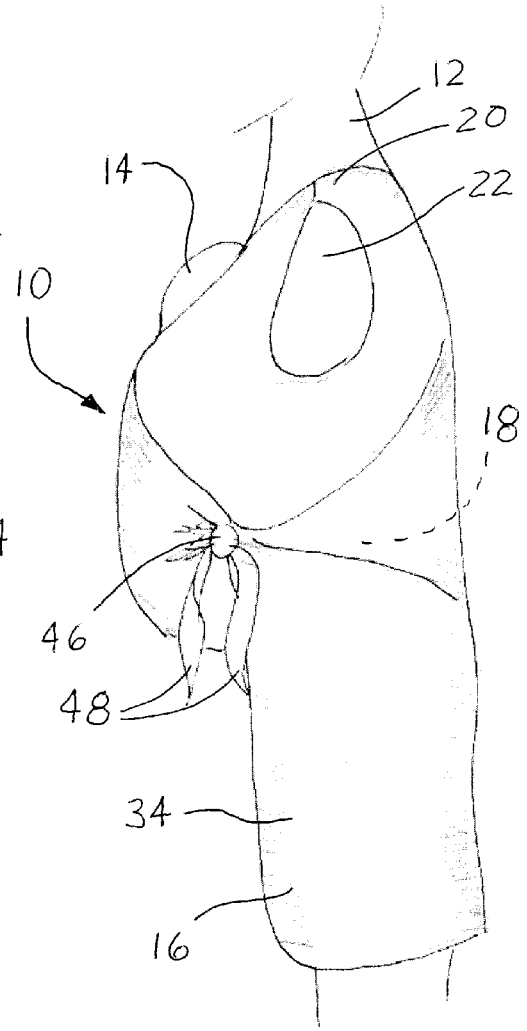
FIG. 2 illustrates a side view of the infant support garment illustrated in FIG. 1.
Figure 3:
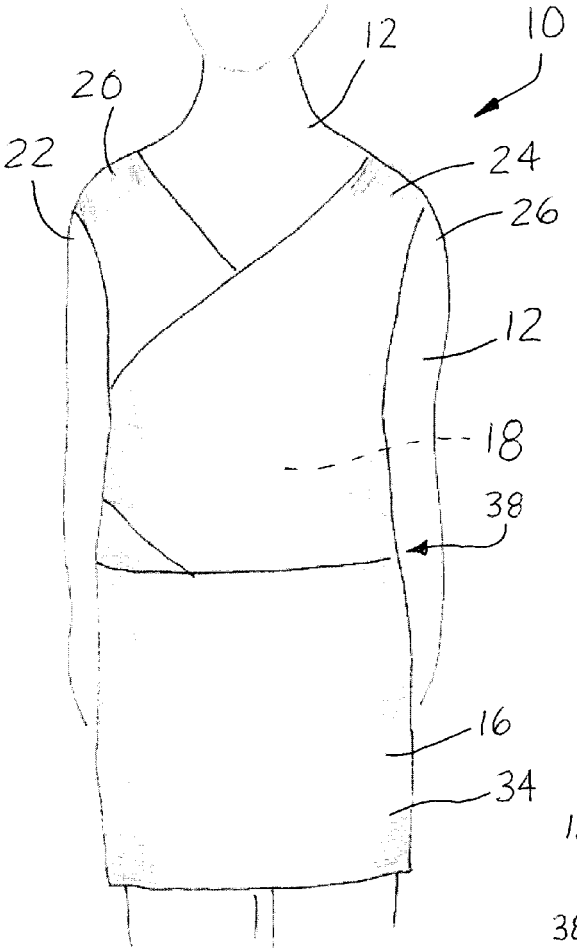
FIG. 3 illustrates a rear view of the infant support garment illustrated in FIG. 1.
Figure 4:
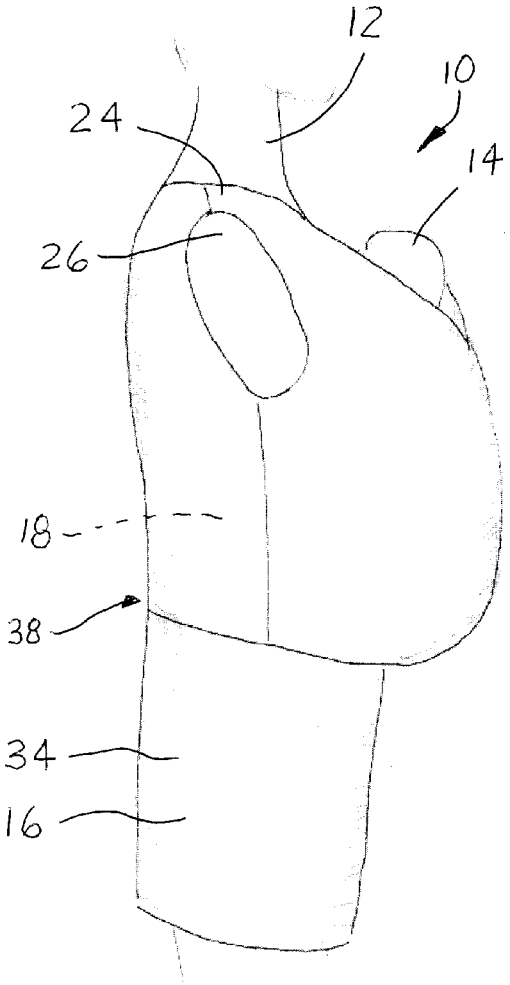
FIG. 4 illustrates another side view of the infant support garment illustrated in FIG. 1.

Referring to FIGS. 1-4, an exemplary embodiment of an infant support garment 10 of the present invention is shown, herein after referred to as garment 10. The garment 10 is shown worn by an individual 12 and encompassing an infant 14. The garment 10 includes a tubular member 16 configured to be worn about a torso 18 of the individual 12. The garment 10 further includes a first shoulder member 20 configured for draping over a first shoulder portion 22 of the individual 12 and a second shoulder member 24 configured for draping over a second shoulder portion 26. The first shoulder member 20 forms a first pocket 28 between the first shoulder member and individual 12. The first pocket 28 being configured for encompassing the infant 14. The second shoulder member 24 forms a second pocket 30 between the second shoulder member and individual 12. The second pocket 30 is configured to encompass the infant 14.

In one particular exemplary embodiment, referring to FIG. 14 through 17, the tubular member 16 includes an upper portion 32 and a lower portion 34. The lower portion 34 is suitable for folding over the upper portion 34, first shoulder member 20 and second shoulder member 24 for forming a third pocket 36 between the lower portion 32 and individual 12. The third pocket 32 being configured for encompassing the infant 14. It should be appreciated that in one configuration the first pocket 28 and second pocket 30 are overlapping. In yet another configuration the first pocket 28, second pocket 30 and third pocket 36 are overlapping.

In greater detail, referring to FIGS. 1, 2, 5, 6, 22 and 23, the garment includes the tubular member 16 which is configured to be worn about the torso 18 portion of an individual 12. In one exemplary embodiment, the tubular member 16 is configured to extend from approximately a breast portion to an upper pelvic portion, just below the waist. In another exemplary embodiment, the tubular member 16 is configured to extend from approximately a breast portion to below a pelvic portion. In the latter configuration, it is contemplated that the tubular member 16 includes an upper portion 32 and a lower portion 34, wherein the upper portion provides support for the waist and rib portion of the individual 12 and the lower portion 34 provides support for a hip portion of the individual. Also, as previously mentioned, the lower portion 34 may be folded upward to a raised position to form a third pocket 36 and provide added support to the waist and rib portion and/or to the infant 14. In one configuration, the upper portion 32 and lower portion 34 of the tubular member 16 are attached together, via sewing or otherwise, at a center portion 38 of the tubular member.

The tubular member 16 includes a length 'L' extending approximately from a breast portion to an upper pelvic portion or to below a pelvic portion of the individual 12. To that end, it is contemplated that the tubular member 16 extends lengthwise and includes a length 'L' of approximately 6 to 12 inches, 9 to 15 inches, 12 inches, 12 to 24 inches, 12 to 36 inches, greater than 36 inches or otherwise.

The tubular member 16 is sized and shaped to be utilized as a body shaper, for men or women, to sculpt the exterior shape of the wearer. As such, in one exemplary embodiment, the tubular member 16 is formed of a flexible material, stretchable and/or elastic material or both. In one particular exemplary embodiment, the material forming the tubular member 16 is formed of a flexible elastic material, such as Spandex or the like. However, other materials such as stretch denim, stretch velvet, stretch vinyl, stretch lace, stretch lining or otherwise may also be used. It should be appreciated that the tubular member 16 may be formed substantially of a single material or may include multiple materials. In one exemplary embodiment, the material forming the upper portion 32 and lower portion 34 are different to provide greater flexibility or stretchability. In one particular exemplary embodiment, it is contemplated that the lower portion 34 may comprise a material that has greater flexibility for folding over the first portion to form the third pocket 36. Also, greater flexibility or stretchability provides easier movement of the pelvic portion of the individual 12.

Figure 5:
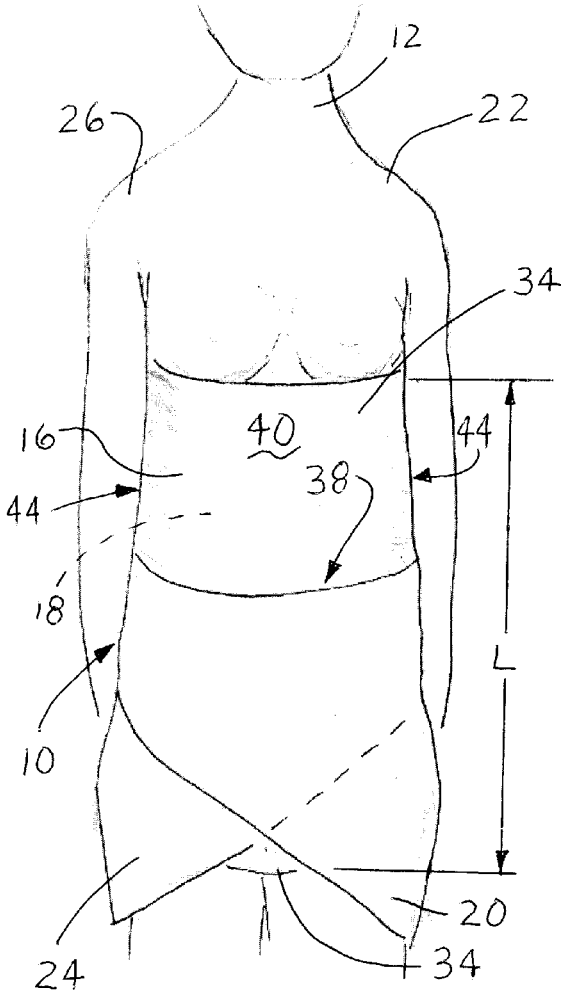
FIG. 5 illustrates a front view of the infant support garment illustrated in FIG. 1 with two shoulder members in a lowered position.
Figure 6:
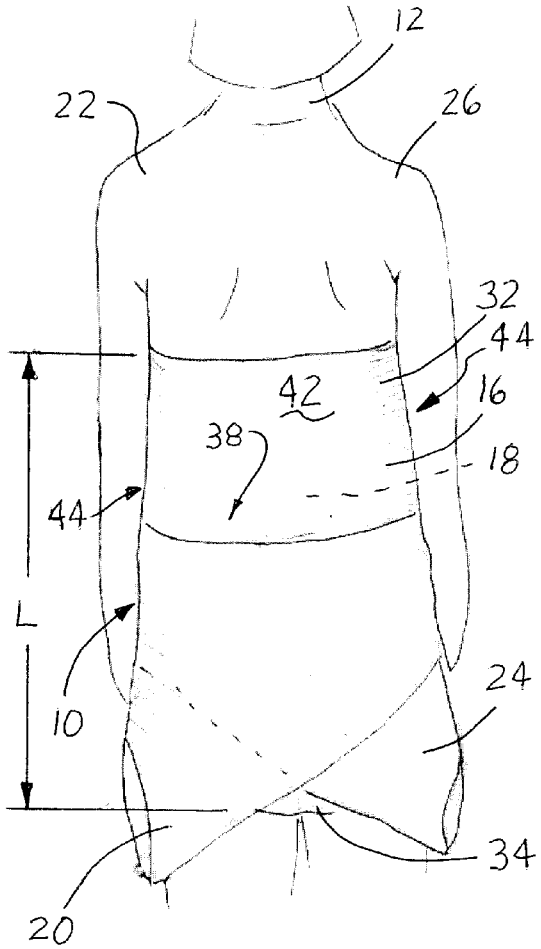
FIG. 6 illustrates a rear view of the infant support garment illustrated in FIG. 1 with two shoulder members in a lowered position.
Figure 7:
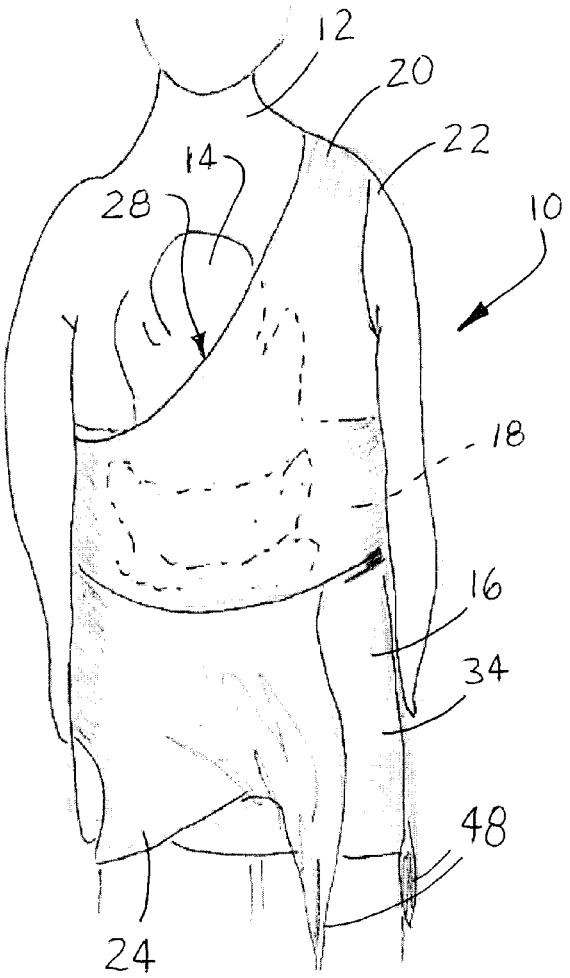
FIG. 7 illustrates a front view of the infant support garment illustrated in FIG. 1 with one shoulder member in a lowered position.
Figure 8:
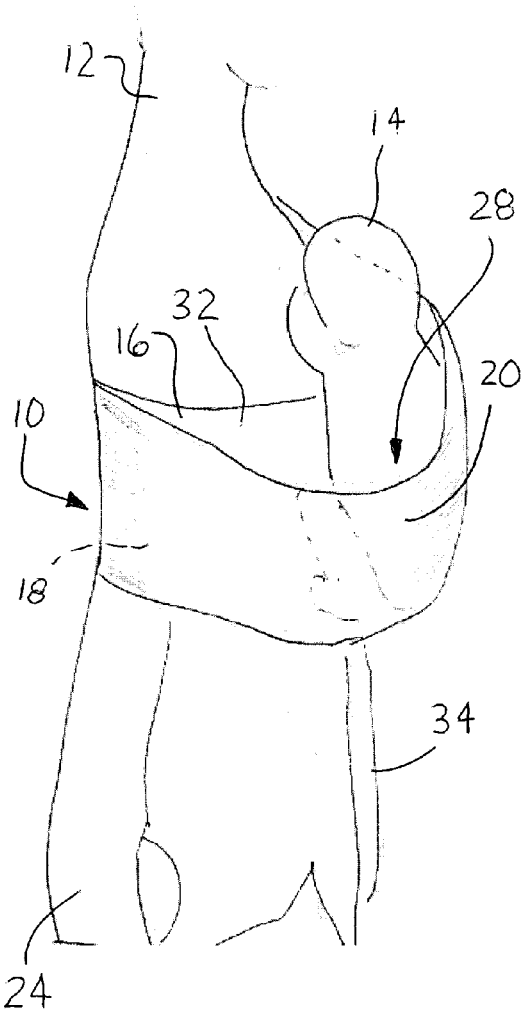
FIG. 8 illustrates a side view of the infant support garment illustrated in FIG. 1 with one shoulder member in a lowered position.
Figure 9:
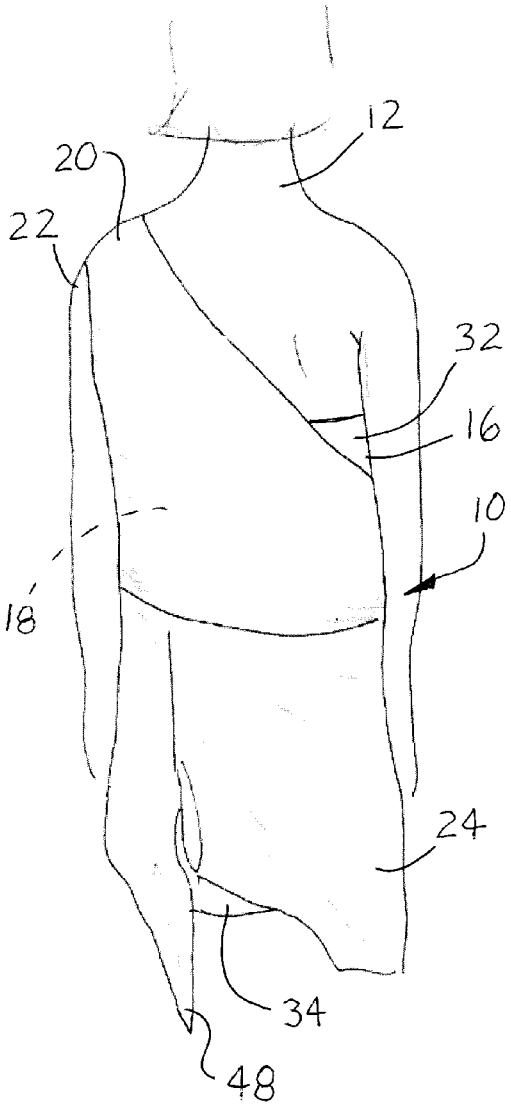
FIG. 9 illustrates a rear view of the infant support garment illustrated in FIG. 1 with one shoulder member in a lowered position.
Figure 10:
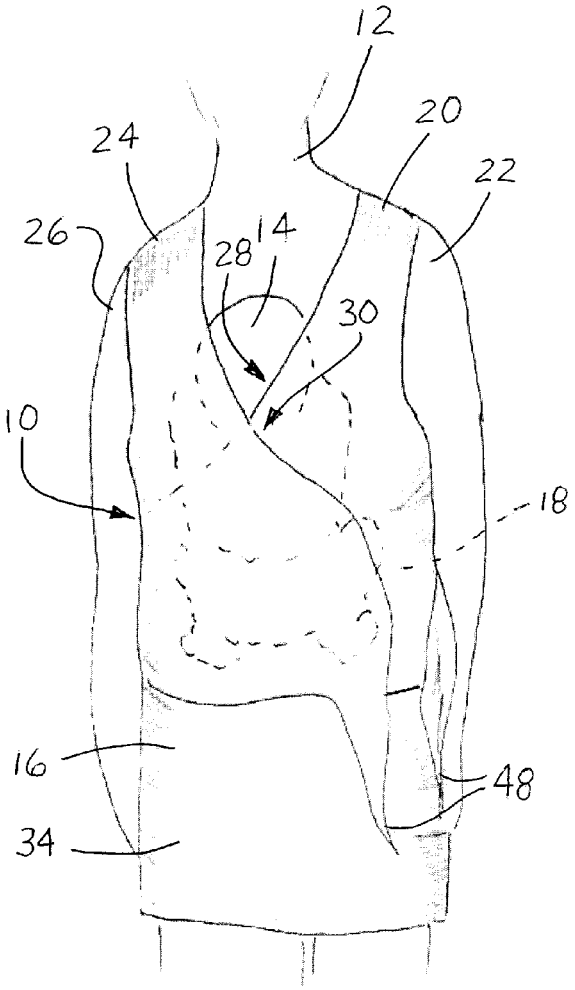
FIG. 10 illustrates a front view of the infant support garment illustrated in FIG. 1 with both shoulder members in a raised position and a second shoulder member in an unsecured configuration.
Figure 11:
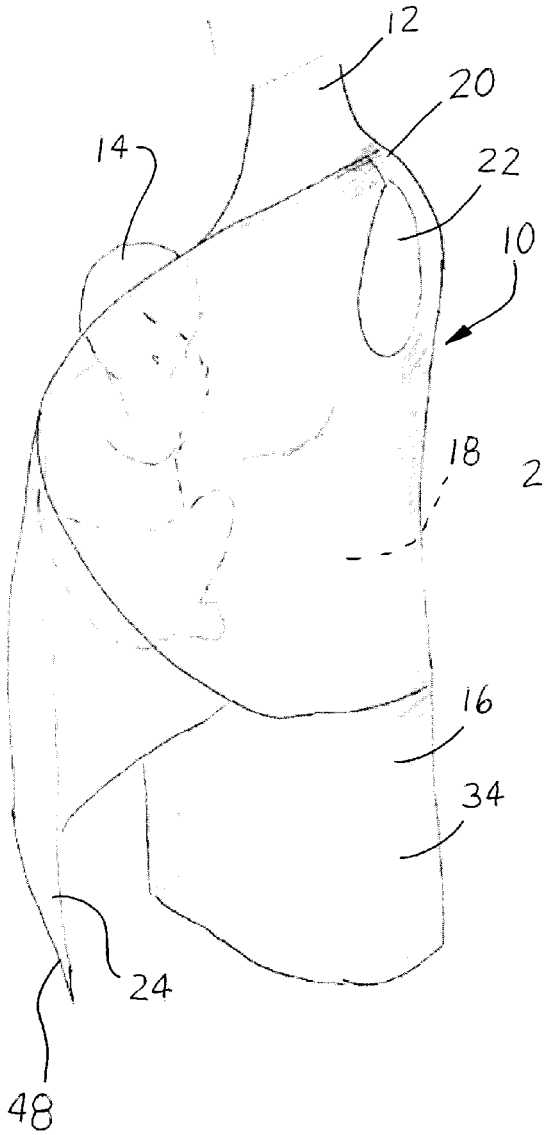
FIG. 11 illustrates a side view of the infant support garment illustrated in FIG. 1 with both shoulder members in a raised position and a second shoulder member in an unsecured configuration.
Figure 12:
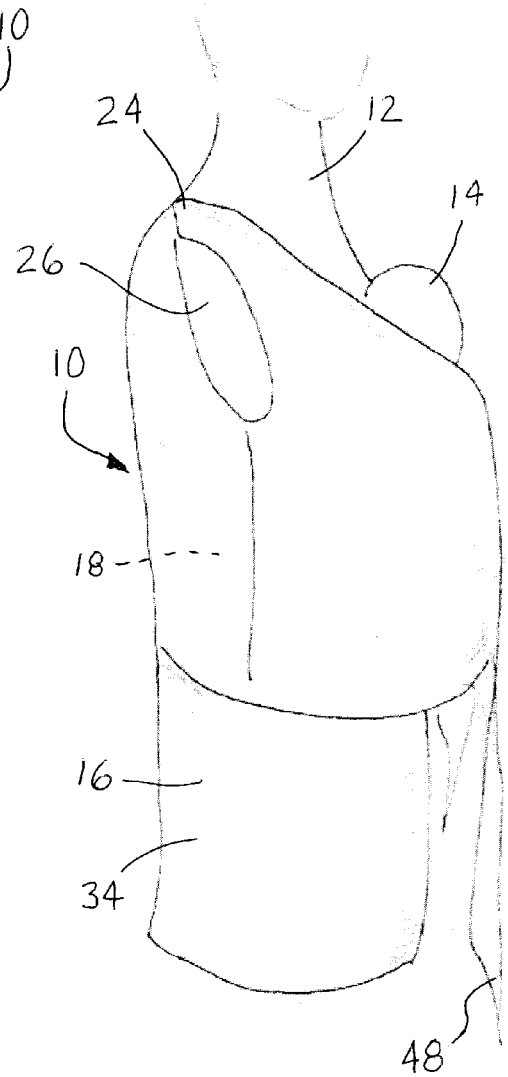
FIG. 12 illustrates another side view of the infant support garment illustrated in FIG. 1 with both shoulder members in a raised position and a second shoulder member in an unsecured configuration.
Figure 13:
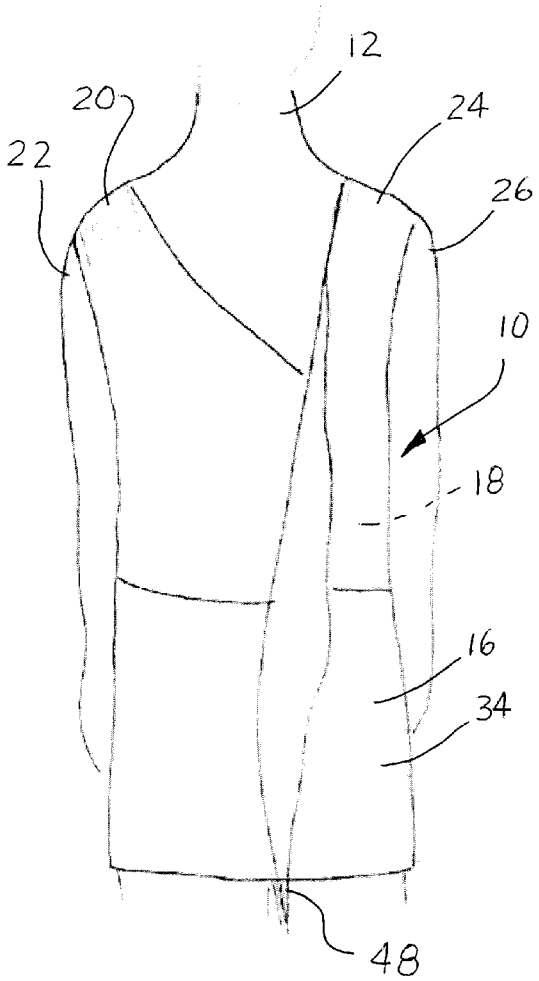
FIG. 13 illustrates a rear view of the infant support garment illustrated in FIG. 1 with both shoulder members in a raised position and a second shoulder member in an unsecured configuration.
Figure 14:
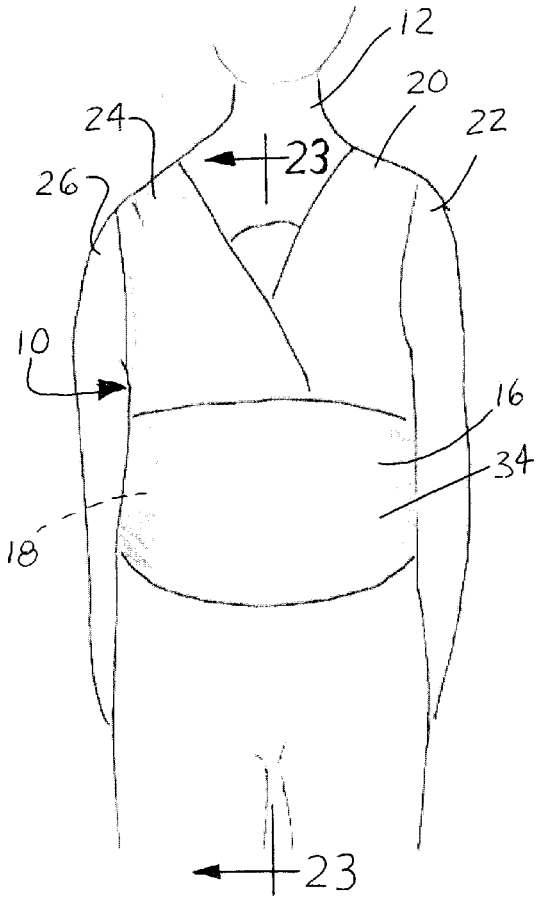
FIG. 14 illustrates a front view of the infant support garment illustrated in FIG. 1 with both shoulder members in a raised position and a portion of a tubular member covering the two shoulder members.
Figure 15:
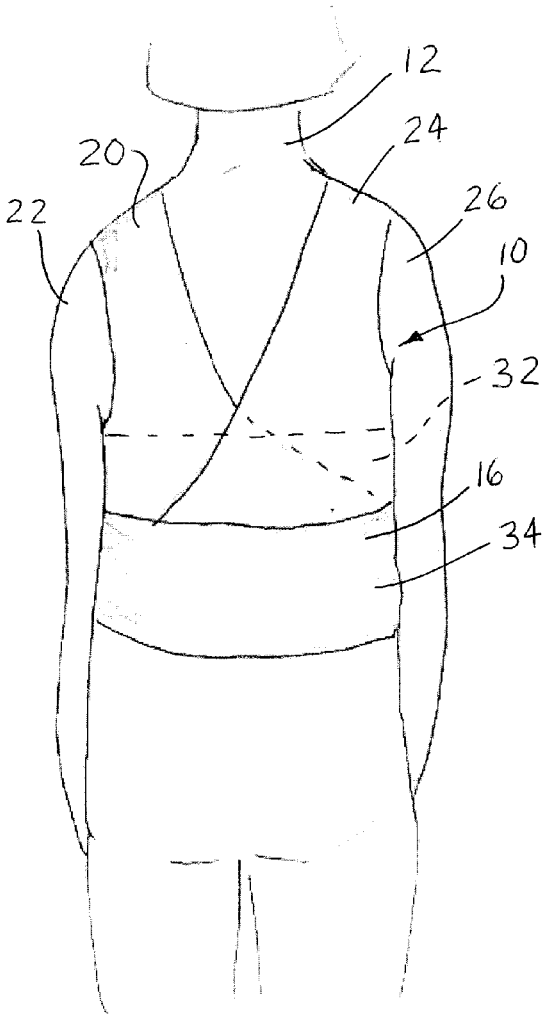
FIG. 15 illustrates a rear view of the infant support garment illustrated in FIG. 1 with both shoulder members in a raised position and a portion of a tubular member covering the two shoulder members.
Figure 16:
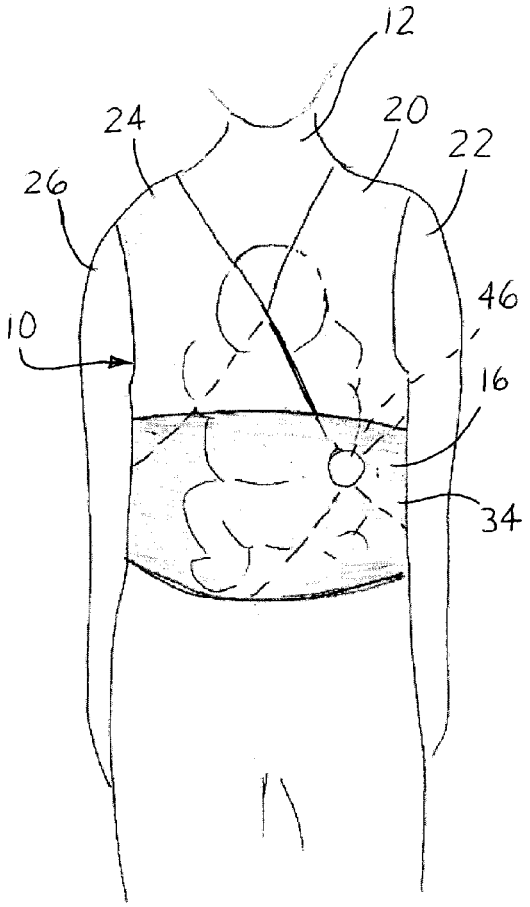
FIG. 16 illustrates a front view of the infant support garment illustrated in FIG. 1 with both shoulder members in a raised position and a portion of a tubular portion covering the two shoulder portions and an infant shown in hidden lines.
Figure 17:
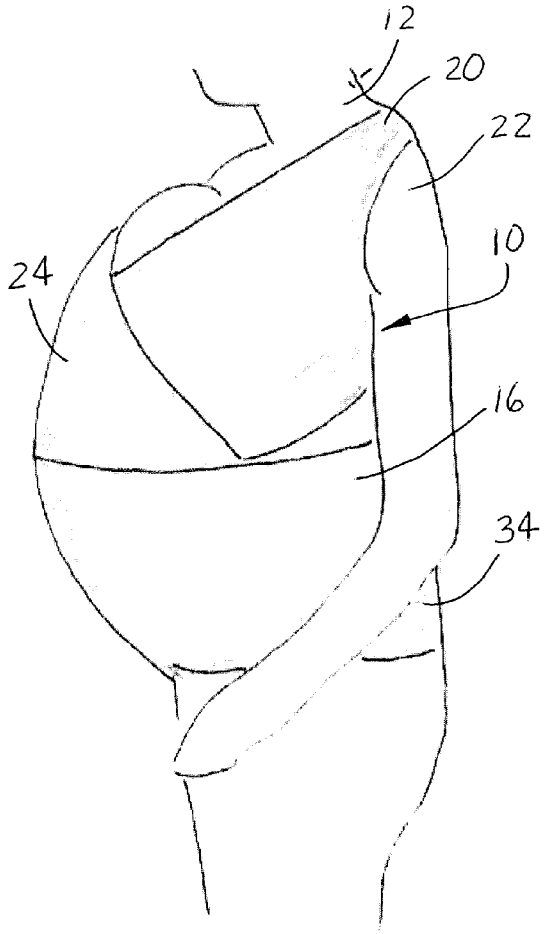
FIG. 17 illustrates a side view of the infant support garment illustrated in FIG. 1 with both shoulder members in a raised position and a portion of a tubular portion covering the two shoulder members.
Figure 18:
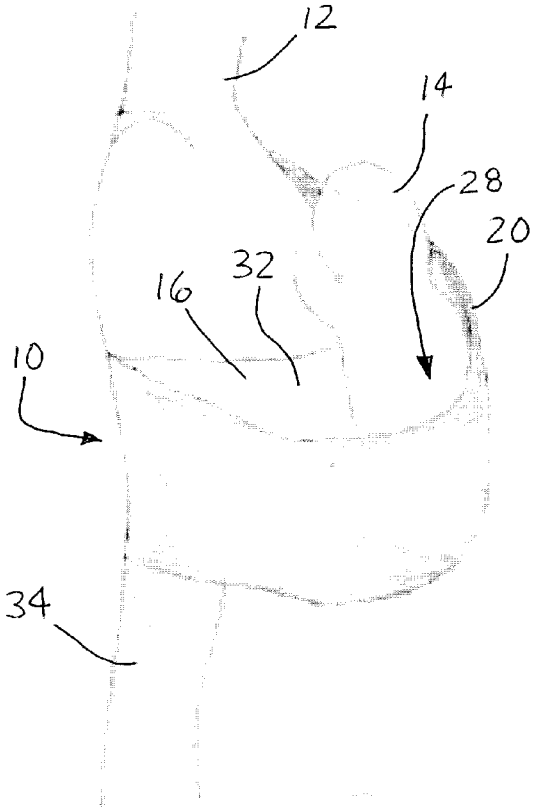
FIG. 18 illustrates a side view of another exemplary infant support garment with removable shoulder member according to the teachings of the present invention.
Figure 22:
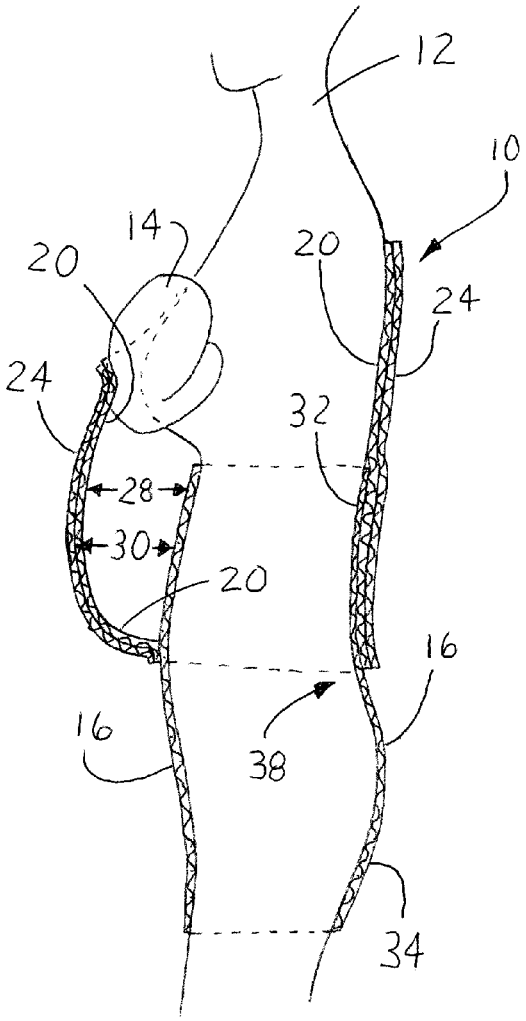
FIG. 22 illustrates a cross-sectional view of the infant support garment illustrated in FIG. 1.
Figure 23:
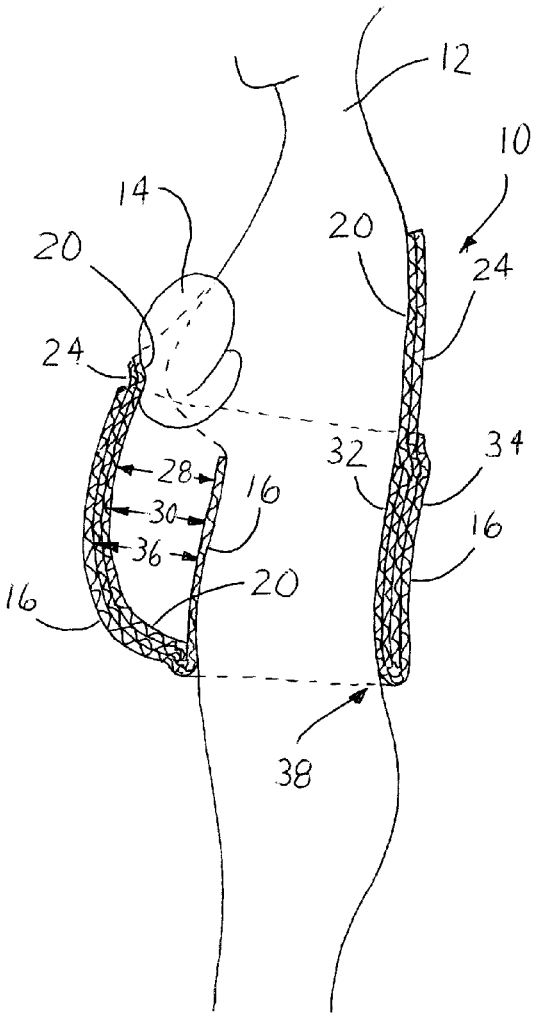
FIG. 23 illustrates a cross-sectional view of the infant support garment illustrated in FIG. 14.

Referring to FIGS. 5-9, 18, 22 and 23, views of the first shoulder member 20 of the garment 10 are shown. In FIGS. 5 and 6 the first shoulder member 20 is shown in a down hanging position, FIGS. 7-9 shows the first shoulder member in an up installed position and FIGS. 22 and 23 shows a cross-sectional view of the first shoulder member. As mentioned, the first shoulder member 20 forms a first pocket 28 with the individual 12 and more particularly with the upper portion 32 of the tubular member 16. In one configuration, the first shoulder member 20 includes an upper portion configured for hanging over the first shoulder portion 22 to provide support to the first shoulder member 20 and the infant 14. The first shoulder member 20 also includes a lower portion that is attached to the center portion 38 of the tubular member 16, via sewing or otherwise, to secure the infant 14 within the first pocket 28. In one exemplary embodiment, the first shoulder member 20 is attached approximately 360° about the tubular member 16. In one exemplary embodiment, the lower portion of the first shoulder member 20 forms a tubular portion. Accordingly, the first pocket 28 may extend entirely around the tubular member 16, e.g. front portion 40, rear portion 42 or side portions 44, or may be limited to the front portion 40, or otherwise, through attachment configurations.

The first shoulder member 20 is sized and shaped to form the first pocket 28. In one exemplary embodiment, the first shoulder member 20 is formed of a flexible material, stretchable and/or elastic material, or both, to form a soft and flexible first pocket 28 for the infant 14, but still provide ample support for maintaining or assisting in maintaining the infant substantially against the skin or clothing of the individual 12. In one particular exemplary embodiment, the material forming the first shoulder member 20 comprises a flexible elastic material, such as Spandex or the like. However, other materials such as stretch denim, stretch velvet, stretch vinyl, stretch lace, stretch lining or otherwise may also be used. It should be appreciated that the first shoulder member 20 may be formed substantially of a single material or may include multiple materials. In one exemplary embodiment, it is contemplated that the material forming the first shoulder member 20 is more flexible than that material forming the second shoulder member 24, as discussed herein in greater detail.

Figure 19:
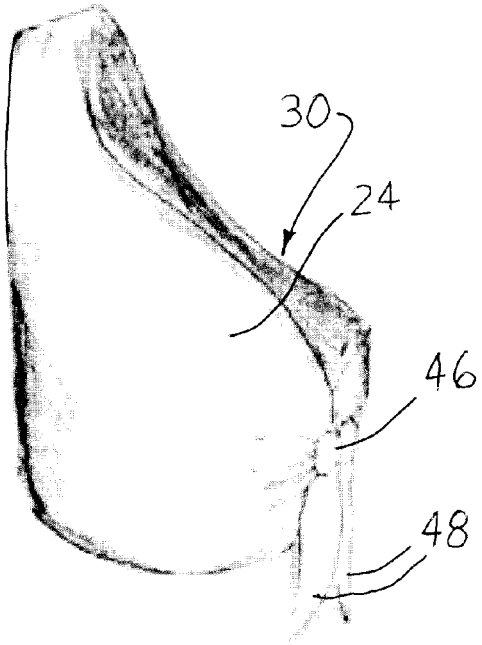
FIG. 19 illustrates a front perspective view of an exemplary removable shoulder member useable with the exemplary infant support garment according to the teachings of the present invention.
Figure 20:
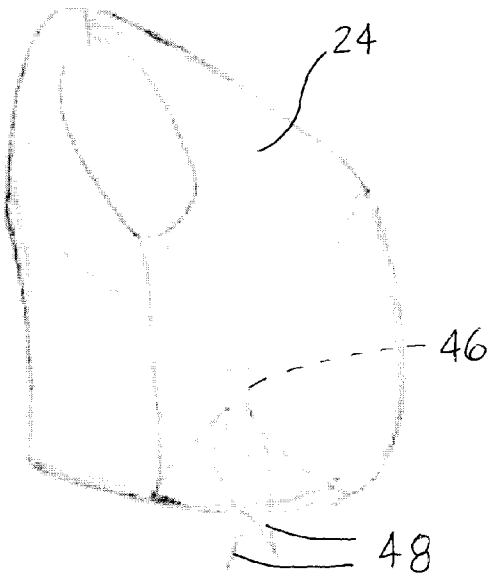
FIG. 20 illustrates a side view of the exemplary removable shoulder member shown in FIG. 19.
Figure 21:
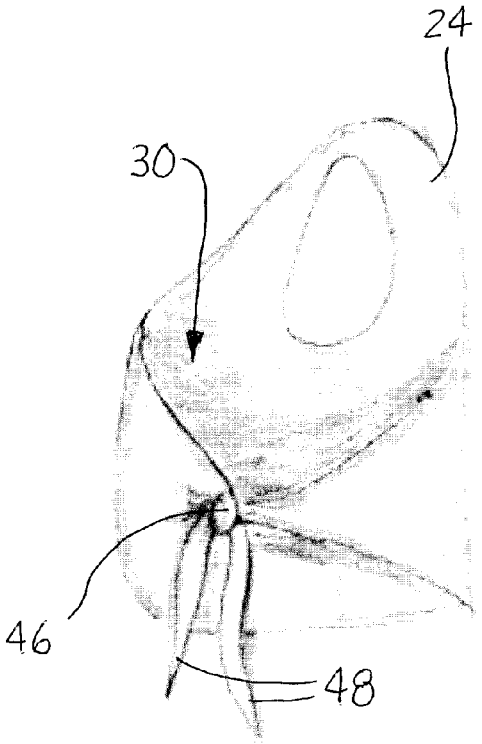
FIG. 21 illustrates another side view of the exemplary removable shoulder member shown in FIG. 19.

Referring to FIGS. 1-4, 7-9, 10-13, 19-21, 22 and 23, views of the second shoulder member 24 of the garment 10 are shown. In FIGS. 1-4, the second shoulder member 24 is shown in an up, installed and secured position, FIGS. 7-9 show the second shoulder member in a down position, FIGS. 10-13 show the second shoulder member in an up installed position, FIGS. 19-21 show a removable second shoulder member, and FIGS. 22 and 23 show a cross-section view of the second shoulder member. As mentioned, the second shoulder member 24 forms a second pocket 30 with the individual 12 and more particularly with the upper portion 32 of the tubular member 16. As shown in FIGS. 22 and 23, a portion of the first pocket 28 is disposed within the second pocket 30.

In one configuration, the second shoulder member 24 includes an upper portion configured for hanging over the second shoulder portion 26 to provide support to the second shoulder member and the infant 14. The second shoulder member 24 also includes a lower portion that is disposed proximate to the center portion 38 of the tubular member 16. In one configuration, the lower portion of the second shoulder member 24 is attached to a side portion 44 and center portion 38 of the tubular member 16. The side attachment of the second shoulder member 24 to the tubular member extends from the center portion 38 to approximately the top of the upper portion 32 of the tubular member 16. In another configuration, similar to the first shoulder member 20, the second shoulder member 24 is further radially attached to the tubular member 16 about the center portion 38. In one configuration the second shoulder member 24 is attached approximate 90° about the tubular portion 16 from the side portion 44 to the front portion 40. In another configuration the second shoulder member 24 is attached approximately 180° about the tubular portion 16 from the rear portion 42 to the front portion 40. In yet another configuration the second shoulder member 24 is attached approximately 360° about the tubular portion.

In one exemplary embodiment, referring to FIGS. 19-21, the second shoulder member 24 is removable from the tubular member 16, first shoulder member 20 or both. This removability provides the ability to change sizes, shapes and appearances of the second shoulder member 24 and hence the garment 10. In one particular exemplary embodiment, releasable attachment members, such as hook and latch Velcro® configurations or otherwise, are used to releasably attach the second shoulder member 24 to the tubular member 16, first shoulder member 20 or both. It should be appreciated that attachment of the second shoulder member 24 includes any of the attachment configurations previously discussed with respect to attachment of the second shoulder member to the tubular member 16.

The garment 10 further includes an adjustment feature 46 for adjusting and maintaining the amount of firmness against the infant 14. The adjustment feature 46 may be configured for adjusting the volume space of the first pocket 28, second pocket 30 or both. The adjustment feature 46 may comprise any suitable adjustment features including ties, hook and latch Velcro® strips on opposing members, mechanical fasteners or otherwise.

In one exemplary embodiment, the adjustment feature 46 is formed or included with the second shoulder member 24. In one particular exemplary embodiment, the second shoulder member 24 includes end portions 48 that are connected to the portion of the second shoulder member forming the second pocket 30. As such, the end portions 48 can be tied in a manner to effect the amount of tension across the infants back 14, the amount of volume within the second pocket 30 and/or even the amount of volume within the first pocket 28.

The second shoulder member 24 is sized and shaped to form the second pocket 30. In one exemplary embodiment, the second shoulder member 24 is formed of a flexible material, stretchable and/or elastic material, or both, to form a soft and flexible second pocket 30 for the infant 14, but still provide ample support for maintaining or assisting in maintaining the infant substantially against the skin or clothing of the individual 12. In one exemplary embodiment, the material forming the second shoulder member 24 comprises a flexible elastic material, such as Spandex or the like. However, other materials such as stretch denim, stretch velvet, stretch vinyl, stretch lace, stretch lining or otherwise may also be used. It should be appreciated that the first shoulder member 20 may be formed substantially of a single material or may include multiple materials. In one exemplary embodiment, it is contemplated that the material forming the second shoulder member 24 is less elastic than that material forming the first shoulder portion 20. Advantageously, this allows for firmer pressure to be placed against the infant so as to maintain closeness, limit movement and/or maintain proper ergonomics.

In view of the foregoing, the present invention further provides a method of use of the garments 10 of the present invention. Referring to FIGS. 5 and 6, the individual 12 inserts their feet or head through the opening formed by the tubular member 16. The tubular member 16 is smoothed over the surface of the individual's 12 clothing or skin and extending from the breast portion, albeit male or female, to an upper portion or lower portion of the pelvic region, depending upon the configuration. Referring to FIGS. 7-9, the individual 12 places their arm through an opening formed by the first shoulder member 20 to form the first pocket 28. The infant 14 is then placed in the first pocket 28. Referring to FIGS. 10-13, the individual 12 then places their other arm through an opening formed by the second shoulder member 24 to form the second pocket 30, which now envelops the infant 14. Referring to FIGS. 1-4, the adjustment feature of the second shoulder member 24 is utilized to provide suitable tension on the back of the infant, which also modifies the volume of the second pocket 30. In this configuration, this is performed by tying end portions 48 of the second shoulder member 24 together to form the desired tension and volume of the second pocket 30. Referring to FIGS. 14-17, optionally, the lower portion 34 of the tubular member 16 is lifted to a raised portion to cover the first shoulder member 20, second shoulder member 24 and form the first pocket 36 thereby providing additional support and security to the infant 14.

While the invention has been described with reference to a preferred embodiment it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An infant support garment, comprising: a tubular member having a front portion and a rear portion; a first shoulder member extending to the front portion of the tubular member, the first shoulder member forming a first pocket with the tubular member; and wherein the first shoulder member extends to and is attached to the rear portion of the tubular member; and a second shoulder member extending to the front portion of the tubular member, the second shoulder member forming a second pocket with the tubular member, wherein the first pocket and the second pocket are overlapping.

2. The infant support garment of claim 1, wherein the tubular member is formed of flexible elastic material.

3. The infant support garment of claim 1, wherein the tubular member is suitable in length and wherein the length of the tubular member is 12 to 36 inches.

4. The infant support garment of claim 1, wherein the first shoulder member is attached to the front portion of the tubular member.

5. The infant support garment of claim 1, wherein the first shoulder member is formed of flexible elastic material.

6. The infant support garment of claim 1, wherein the second shoulder member is attached to the front portion of the tubular member.

7. The infant support garment of claim 1, wherein the second shoulder member extends to and is attached to the rear portion of the tubular member.

8. The infant support garment of claim 1, wherein the second shoulder member includes an adjustment feature to vary the volume of the second pocket.

9. The infant support garment of claim 8, wherein the adjustment features comprises two end portions of the second shoulder member disposed about a center portion of the tubular member, the end portions being configured for adjustable attachment to one another for varying the dimensions of the second pocket.

10. The infant support garment of claim 1, wherein at least a portion of the first pocket is disposed within the second pocket.

11. The infant support garment of claim 1, wherein the second shoulder member can be unattached to the tubular member and replaceable with a similar shoulder member.

12. The infant support garment of claim 1, wherein the second shoulder member is formed of flexible elastic material.

13. The infant support garment of claim 1, wherein the first shoulder portion, the second shoulder portion, or both, are attached proximate a center portion of the tubular member to define an upper portion of the tubular member and a lower portion of the tubular member.

14. The infant support garment of claim 13, wherein the lower portion of the tubular member is moveable to a raised position and a lowered position.

15. The infant support garment of claim 14, wherein in the raised position the tubular member extends over the first shoulder member and the second shoulder member, and in the raised position the lower portion of the tubular member forms a third pocket with the upper portion of the tubular member.

16. The infant support garment of claim 15, wherein at least a portion of the first pocket and the second pocket are disposed within the third pocket.

17. An infant support garment, comprising: a flexible elastic tubular member having a front portion and a rear portion, the tubular member being suitable in length and wherein the length of the tubular member is 12 to 36 inches, a first shoulder member extending from the front portion of the tubular member to the rear portion of the tubular member, the first shoulder member being attached to the front portion of the tubular member and rear portion of the tubular member, the first shoulder member forming a first pocket with the tubular member; a second shoulder member extending from the front portion of the tubular member to the rear portion of the tubular member, the second shoulder member forming a second pocket with the tubular member; an adjustment feature to vary the dimensions of the second pocket.

18. The infant support garment of claim 17, wherein the first should member and the second shoulder member are attached proximate a center portion of the tubular member to define an upper portion and a lower portion, and wherein the lower portion of the tubular member is moveable to a raised position and a lowered position such that in the raised position the tubular member extends over the first shoulder member and the second shoulder member, and in the raised position the lower portion of the tubular member forms a third pocket with the upper portion of the tubular member.

19. An infant support garment, comprising: a tubular member having a front portion and a rear portion; a first shoulder member extending to the front portion of the tubular member, the first shoulder member forming a first pocket with the tubular member; wherein the first shoulder member extends to and is attached to the rear portion of the tubular member; and a second shoulder member extending to the front portion of the tubular member, the second shoulder member forming a second pocket with the tubular member, and wherein the second shoulder member extends to and is attached to the rear portion of the tubular member; wherein the first pocket and the second pocket are overlapping.

* * * * *